United States Patent [19]

Hanson et al.

[11] Patent Number: 4,504,827

[45] Date of Patent: Mar. 12, 1985

[54] SYNTHETIC PERSISTENCE FOR RASTER SCAN DISPLAYS

[75] Inventors: David G. Hanson, Spring Lake Park, Minn.; Robert E. Francis, Quito, Ecuador

[73] Assignee: Sperry Corporation, New York, N.Y.

[21] Appl. No.: 424,734

[22] Filed: Sep. 27, 1982

[51] Int. Cl.[3] ..... G09G 1/16

[52] U.S. Cl. ..... 340/723; 340/744; 340/793

[58] Field of Search ..... 340/723, 771, 772, 732, 340/744, 745, 791, 793

[56] References Cited

U.S. PATENT DOCUMENTS

| | | | |
|---|---|---|---|
| 4,087,806 | 5/1978 | Miller | 340/771 |
| 4,195,293 | 3/1980 | Marzolin | 340/744 |
| 4,200,869 | 4/1980 | Murayama et al. | 340/723 |
| 4,203,107 | 5/1980 | Lovercheck | 340/744 |

*Primary Examiner*—Gerald L. Brigance

*Attorney, Agent, or Firm*—William C. Fuess; Kenneth T. Grace; Marshall M. Truex

[57] ABSTRACT

A method and apparatus for pseudorandomly decrementing the intensity of data that is displayed on a raster scan display screen. The apparatus essentially comprises means for selecting and partially decrementing data from an image memory and means for controlling the rate at which the partially decremented data is written back into the image memory so that an apparently uniform phosphor decay rate is observed by a viewer.

3 Claims, 5 Drawing Figures

SYNTHETIC PERSISTENCE FOR RASTER SCAN DISPLAYS

BACKGROUND OF THE INVENTION

The present invention relates to raster scan displays and, in particular, to a method and apparatus for pseudorandomly varying the apparent phosphor decay rate of images displayed thereon.

Phosphor persistence (i.e. the rate at which the luminescence of the phosphor on a display screen decays) presents many problems to a display system designer. Specifically, provisions must be made for refreshing the phosphor, in order to maintain a display image, as well as to permit the phosphor to decay so as to permit the displaying of new images. Stroke monitor systems, such as employed heretofore in typical radar displays, exhibit desirable decay properties, but such displays are rather expensive, require a relatively large amount of control circuitry and must be operated in a darkened environment.

When implementing a raster scan radar display, however, difficulty arises in that known techniques do not produce images of the same quality as stroke monitor displays. Furthermore, the use of conventional techniques for implementing synthetic persistence on the raster scan display (e.g. by decrementing the display image memory by sectors or quadrants) has been found to produce perceptible jumps in intensity and which in turn, has proven to be very distracting and unnatural for the observer. Such unnatural appearances result from the symmetrical nature of the decrementation of the image memory, and therefore it has been found desirable to decrement the image memory in a manner other than via known symmetrical methods.

Rather, it has been found to be preferable to pseudorandomly decrement the image memory by randomly selecting the data and by randomly varying the times at which the data is decremented and written back into the image memory during refresh operations. Such pseudorandom techniques produce images of greater brightness and enable raster scan displays that possess apparent phosphor decays equivalent to that of stroke monitor displays. Accordingly, it is a primary object of the present invention to produce raster scan displays having pseudorandom synthetic persistence. This object and others will, however, become more apparent upon reading the following description and upon referring to the related drawings.

SUMMARY OF THE INVENTION

Improved raster scan displays wherein the primary image memory is pseudorandomly decremented so as to enable a synthetic phosphor persistence or digital control of the decay thereof. The apparatus enables the selection and partial decrementation of data from the primary image memory as well as the varying of the rate at which the partially decremented data is written back into the memory, thereby refreshing the memory and display image in a pseudorandom manner.

The synthetic persistence apparatus generally comprises means for selectably reading and decrementing the intensity of the data stored within the image memory, means for randomly selecting the data for decrementation and means for randomly writing the decremented data back into the display image memory. The random data selection for decrementation occurs via programmable means which alterably varies a preset count in a counter, the bits of which have been scrambled, so as to randomly select and decrement the data of the image memory. The rate at which the partially decremented data is written back is, in turn, randomly determined by a variable timer.

DESCRIPTION OF THE PREFERRED EMBODIMENT

Figure 1:
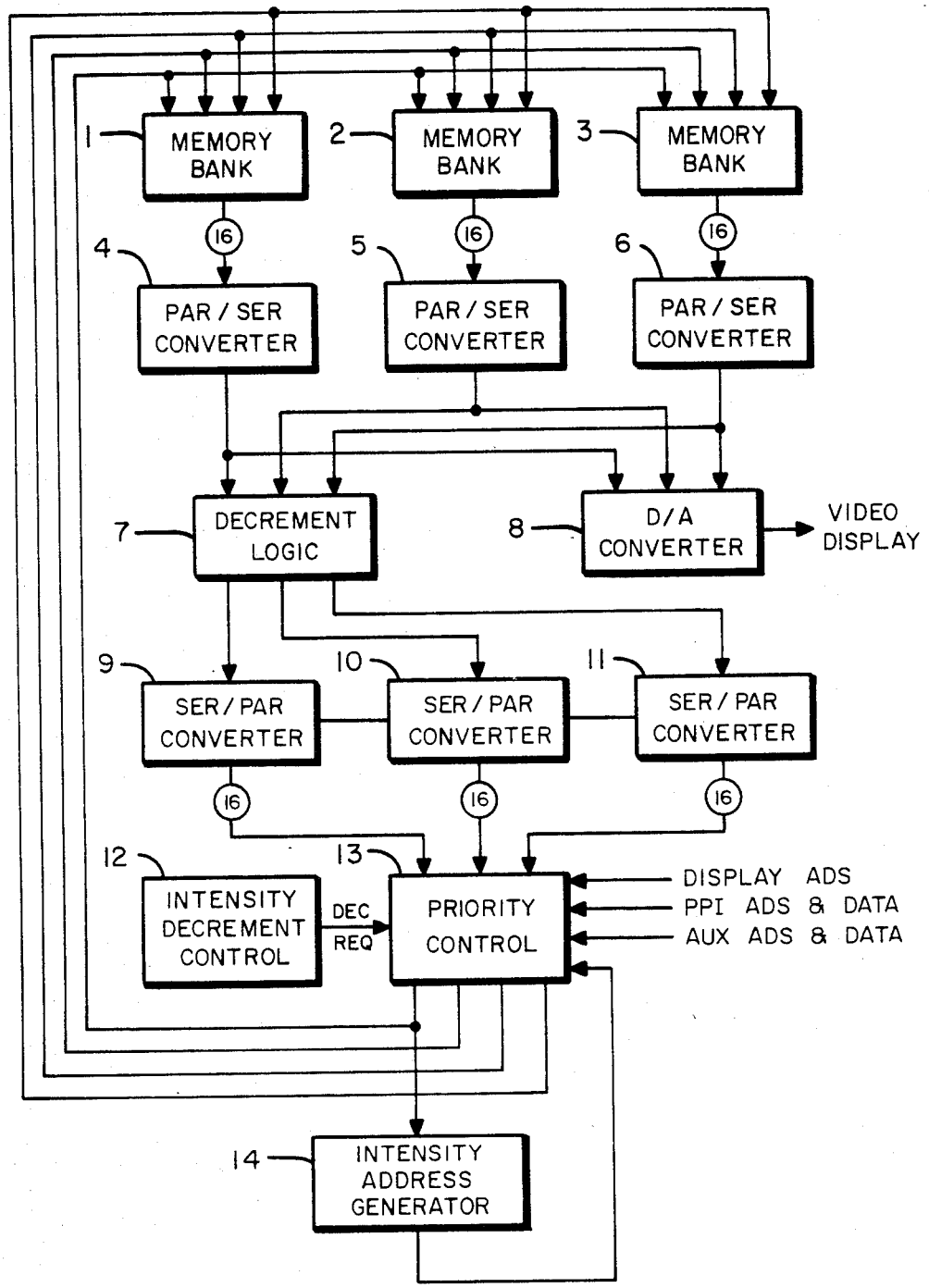
FIG. 1 shows a generalized block diagram of a typical raster scan display system employing the concepts of the present invention.

Referring to FIG. 1, a generalized block diagram is shown of a display system incorporating the present invention. In particular, the display system is comprised of three memory planes 1, 2 and 3 or so-called "banks". Each bank, in turn, is comprised of a 1024 by 1024 by 1 bit array that is organized into four memory stacks, and wherein each memory stack is organized into 16,384 words of 16 bits length. Thus each bank contains approximately 64,000 by 16 bit memory words and each of which is addressably accessable by reading the corresponding rows of the memory banks 1, 2 or 3.

During display refresh, one row from each of the three memory banks 1, 2 and 3 are simultaneously read. Specifically, each stack for each bank is read sequentially so as to impress a 16 bit word from each bank 1, 2 and 3 on a corresponding parallel-to-serial converter 4, 5 and 6. The parallel-to-serial converters 4, 5 and 6, in turn, sequentially read a bit at a time from each of the 16 bit words so as to present a 3 bit code per pixel of the corresponding row of pixels on the display to the decrement logic circuitry 7 and the digital-to-analog converter 8. A new 3 bit code is read once each 25 nanoseconds. The digital-to-analog converter 8, upon receipt of each 3 bit pixel code, converts the digital signals to analog signals and which are used to drive the video display (not shown) at a 40 megahertz rate and thereby refresh the images of the display.

The decrement logic circuitry 7, in turn, decrements by one, selected ones of the 3 bit pixel codes, as each code is impressed on the decrement logic circuitry 7. The decremented and undecremented data is then shifted sequentially into the appropriate serial-to-parallel converters 9, 10 and 11. Thus, upon reading each 16 bit word for each row of the memory banks 1, 2 and 3, partially decremented 16 bit words are reconstructed in the serial-to-parallel converters 9, 10 and 11. Each decremented 16 bit word is then written back into the memory bank at the address from which it was initially read, via the intensity decrement control circuitry 12 and the priority control circuitry 13 in response to the appropriate address signal from the intensity address generator circuitry 14.

The actual writing of the partially decremented data back into the memory banks is controlled by the intensity decrement control circuitry 13, which, at the appropriate times, produces decrement requests to the priority control circuitry. The address to which the partially decremented data is written is determined by the intensity address generator circuitry 14. In particular, the address generator circuitry 14 comprises three 16 bit latches (not shown) that are organized into three ranks; the lower rank is loaded with the present display refresh address for each refresh cycle; the second rank with the previous display refresh address; and the third rank with the refresh address previous to the second rank. Such an address ranking compensates for the delay that is encountered because of the serial-to-parallel conversions. Thus, the above referenced address stacking ensures that the appropriate address is always available for the partially decremented data as each address of the memory is refreshed, the partially decremented data is not written back into the memory, however, until a decrement request is generated.

In summary, as the memory locations corresponding to the pixels of the images on the display screen are refreshed, the corresponding data is partially decremented in parallel with the refresh operation and pushed through the serial-to-parallel converters 9, 10 and 11, while the associated addresses are pushed through the ranks of the intensity address generator circuitry 14. The partially decremented data is then written back into the primary image memory banks, upon receipt of decrement requests. If, however, a decrement request is not received as the partially decremented data is reconstructed in the serial-to-parallel converter 9, 10 and 11, that address of memory is not rewritten with the decremented data and the data will overflow. Therefore the circuitry of FIG. 1 essentially operates in the shadow of the normal refresh operations to randomly decrement the image memory data by randomly writing the partially decremented data back into the image memory so as to reduce the intensity of the corresponding pixels during the next refresh operation.

Figure 2:
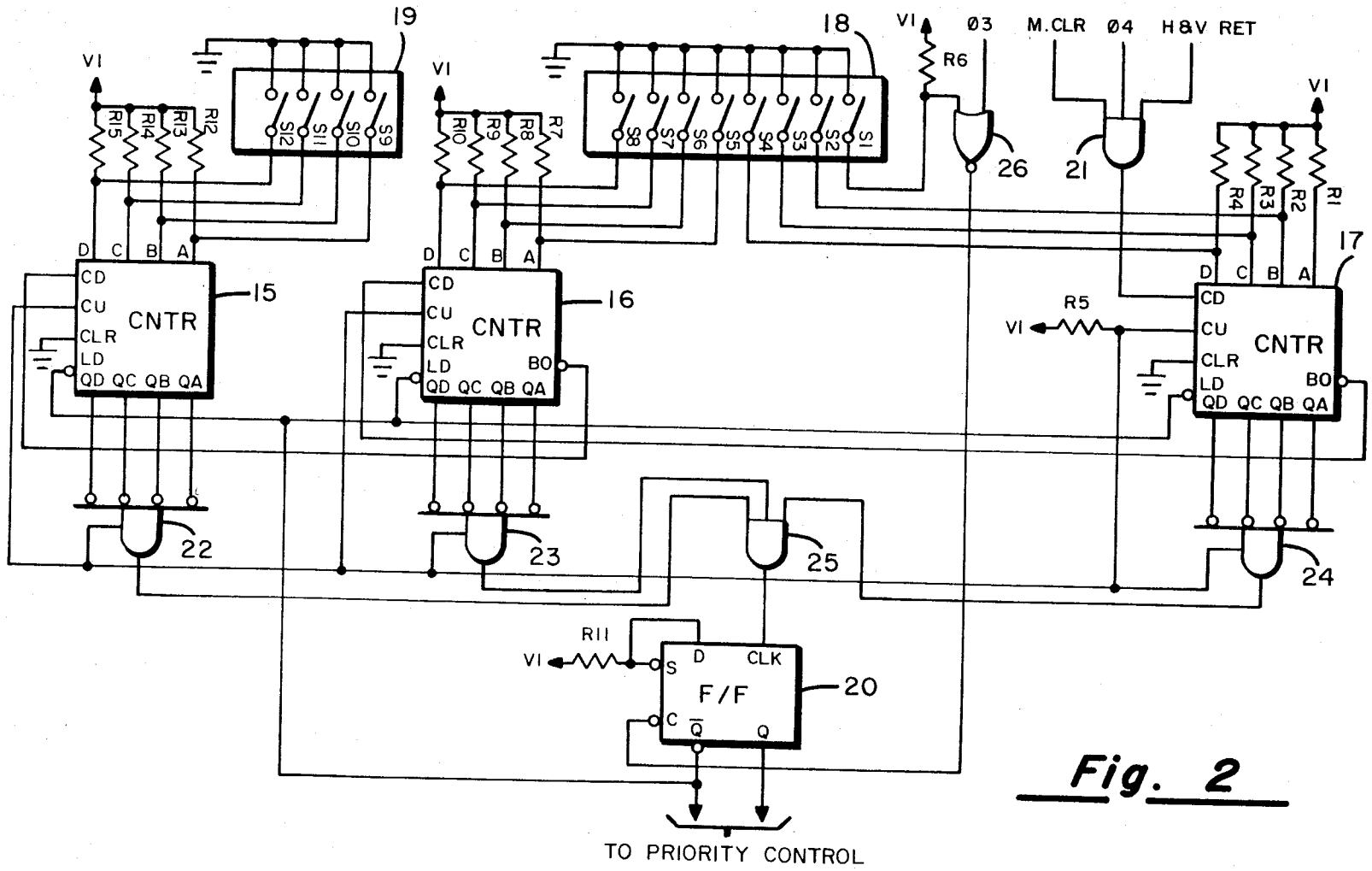
FIG. 2 shows a detailed schematic diagram of the circuitry contained within the intensity decrement control circuitry of FIG. 1.

As mentioned, the frequency and timing for the writing of the thus decremented data back into memory is determined via the intensity decrement control circuitry 12, and which can be seen in detail upon reference to FIG. 2. This circuitry acts to periodically produce decrement request control signals that, in turn, cause the priority control circuitry 13 to write the partially decremented data contained within the serial-to-parallel converters 9, 10 and 11 back into the associated address contained within the ranks of the intensity address generator circuitry 14.

Referring to FIG. 2, the intensity decrement control circuitry 12 essentially comprises presettable counters 15, 16 and 17, programmable switches 18 and 19, flip-flop 20 and associated logic circuitry, all of which will be described hereinafter. During operation, the counter 15, 16 and 17 are periodically present to a count established by the programmable switches 18 and 19, before they are permitted to count down to 0 via NAND gate 21. NAND gate 21 is disabled during those portions of each memory cycle that correspond to the display's horizontal and vertical blanking periods and the master clear operation, due to the logic low inputs to NAND gate 21 that occur during these times. However, upon the occurrence of the $\phi 4$ clock, all the inputs to NAND gate 21 are at a logic high and NAND gate 21 then impresses a logic high on the CD terminal of counter 17. These logic highs, in turn, cause counter 17 to decrement its count so as to eventually produce overflow outputs on its $B_0$ terminal which, in turn, ripple through counter 16. Counter 16, once it overflows, then produces similar signals on its $B_0$ terminal and which then cause counter 15 to decrement its count. In a similar fashion for each memory cycle, the counter 15, 16 and 17 are decremented from their preset count, until they each count down to 0.

As the counters 15, 16 and 17 count down to 0, the logic conditions of NAND gates 22, 23 and 24 are satisfied and they, in turn, produce logic high outputs which cause AND gate 25 to produce a logic high output and set decrement flip-flop 20. Upon the setting of decrement flip-flop 20, a logic high indicative of a decrement request is produced and coupled to the priority control circuitry 13. The occurrence of the decrement request at the priority control circuitry 13, as mentioned, then causes the priority control circuitry 13 to write the then current data resident in the serial-to-parallel converters 9, 10 and 11 into the corresponding memory banks 1, 2 and 3 at the address contained within the corresponding register of the intensity address generator circuitry 14. The logic high from the decrement request flip-flop 20 continues until the $\phi 3$ clock, at which time NOR gate 26 produces a logic low, whereby flip-flop 20 is cleared before the next memory cycle.

Before continuing, it is to be noted that the decrement request flip-flop 20 can be disabled (i.e. prevented from clearing at the end of each memory cycle) via the opening of the switch 1 of the programmable switch 18. To do so, however, causes the addresses in memory to be written with decremented data each memory cycle, rather than on a random time basis. Thus, such a condition permits an alternate refresh scheme that is random only in its selection of data.

The pseudorandom writing of the decremented data back into memory is thus obtained via the preset count of the programmable switches 18 and 19 that is loaded into the presettable counters 15, 16 and 17. In the preferred embodiment, pseudorandom refreshing occurs via the loading of different fixed, odd values into the counters 15, 16 and 17. The odd values are ensured via the loading of a binary 1 into the lowest ordered bit of counter 17; while the fixed settings result from a predetermined value that is impressed on the remaining switches of the programmable switches 18 and 19. The specific fixed values that are employed for any given desired phosphor decay rate will depend upon one's preferences, but it is to be recognized that not all fixed values produce desirably appearing image decays, nor is any one set of values preferable over another, due to subjective differences from operator to operator. For the present embodiment, the values were determinted empirically so as to produce a decay rate that appeared uniform across the face of the screen, as opposed to the previously mentioned quadrant by quadrant decay. These empirical values were then encoded into the circuitry of FIG. 3 and which circuitry permits the operator to select the desired decay.

Figure 3:
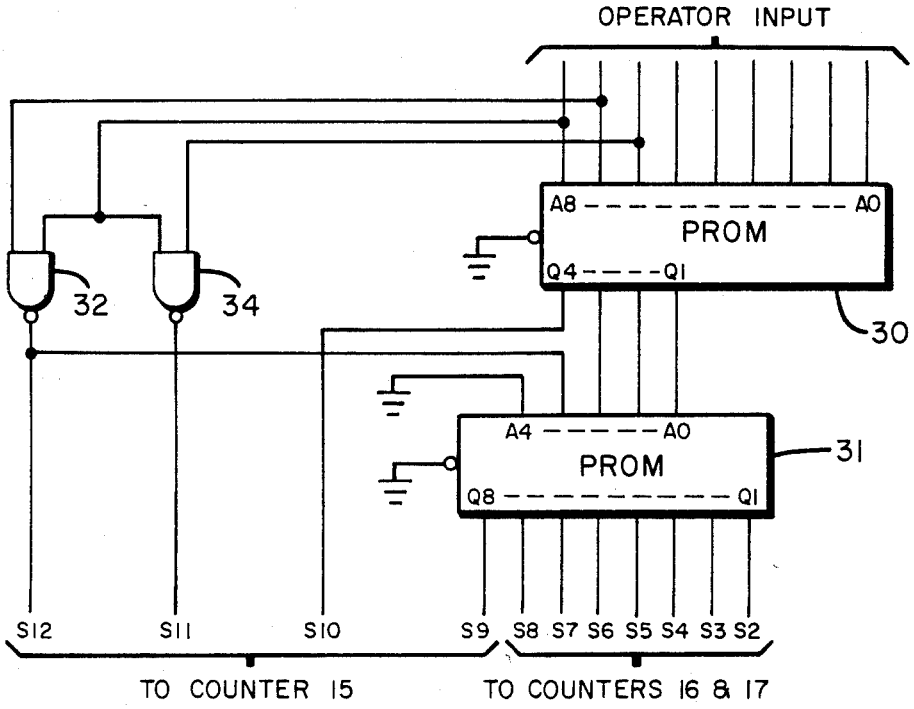
FIG. 3 shows an alternative programmable means for altering the rate at which the display screen is pseudorandomly decremented.

Before referring to FIG. 3, it is to be noted that the mathematical restrictions on the fixed values for the present embodiment are that the values must be (1) odd, (2) not divide into 1024 evenly, and (3) not be divisible by 1024 evenly. These restrictions ensure that all memory locations are written with decremented data over the number of refresh cycles. It is also to be noted that all addresses must be referenced at approximately the same rate, in order to ensure a smooth appearing image.

As mentioned, the preset count that is loaded into the counters 15, 16 and 17 is varied from time to time so as to further enhance the appearance of the decay rate. This function is achieved via the programmable circuitry of FIG. 3. Referring now to FIG. 3, it is to be noted that an operator selectable scheme is shown, wherein programmable read only memories (PROM's) are substituted for the switches 18 and 19, and which PROM's 30 and 31 from time to time vary the fixed odd values in the counters 15, 16 and 17. In particular, and depending upon an operator selected input, the input is impressed on PROM 30 as the address from which yet another number is read and impressed on the address input ports to PROM 31 so as to select yet another number. At the same time, the operator selected input directly establishes a portion of the preset value, via the NAND gates 32 and 33, while the remainder of the preset value is established via the PROMS 30 and 31. The value selected by the circuitry of FIG. 3 is then coupled to the presettable counters 15, 16 and 17 at the start of each memory cycle, following the counters counting down to 0. The PROMS 30 and 31 thus facilitate the apparent phosphor decay rate in that the data or fixed values stored therein can be varied according to a prestored program so as to alter the fixed values at any time and thereby improve the pseudorandom appearance of the phosphor decay.

While the circuitry of FIG. 1, as modified with the programmable control of FIG. 3, enables a synthetic persistence scheme whereby the image memory is decremented by words, it is to be recognized that alternatively and for smaller memories it may be desirable to implement the present synthetic persistence scheme in a bit scheme and which would provide an even smoother appearing phosphor decay. An example of such a bit scheme can been seen upon reference to FIG. 4. In particular, FIG. 4 discloses a local zoom memory of the type disclosed in U.S. patent application Ser. No. 306,831, also assigned to the present assignee. In this embodiment the local zoom memory 40 is comprised of 5 banks of memory, although the number of banks is immaterial, and each bank corresponds to a 256 by 256 by 1 bit array. Each bank, in turn, is organized into a 4,096 word by 16 bit array and each word corresponds to 16 consecutive bits or pixels along any one row of pixels that are defined for the display screen.

Figure 4:
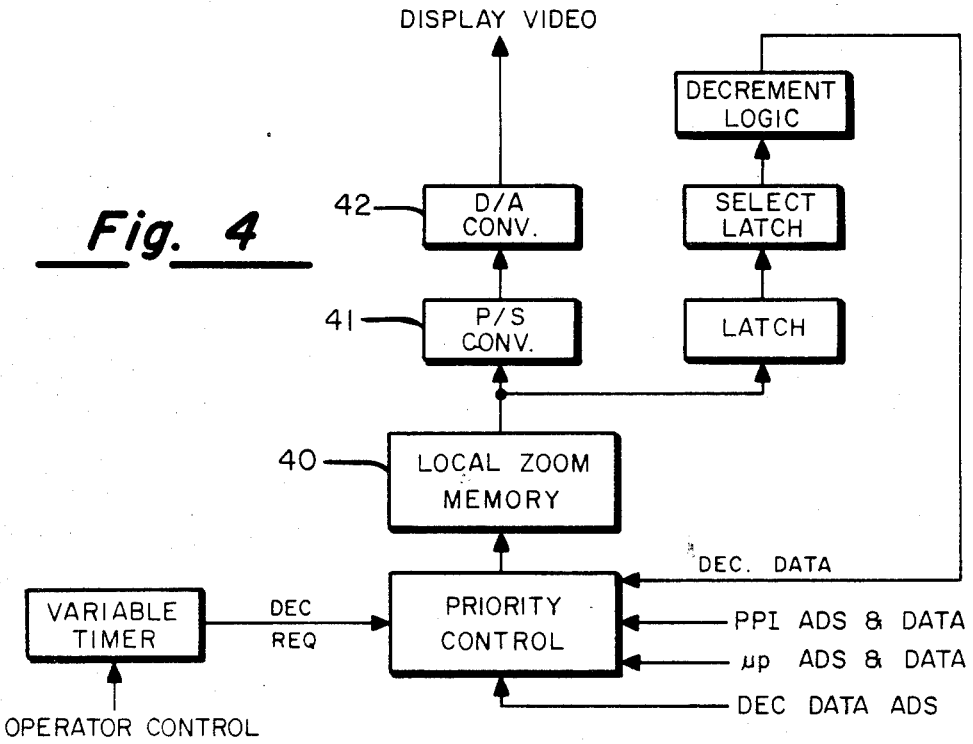
FIG. 4 shows an alternative embodiment for a raster scan display employing a local zoom memory.

The synthetic persistence scheme for the circuitry of FIG. 4 is essentially the same as that previously described, except now during a display refresh one row from all 5 banks are read at the same time and one bit is selected from each bank. Thus, a 5 bit code is presented each 25 nanoseconds to the parallel-to-serial converter 41 and the digital-to-analog converter 42 and which 5 bits, in turn, are impressed sequentially on the video display so as to refresh the corresponding pixel of the display screen.

As before, the pseudorandom decrementation of the data contained in the local zoom memory 40 occurs in the shadow of the normal refresh operations. In particular, each of the five bits of data are written in parallel into the latch 43 and from there into the latch 44. Once the latch 44 is filled, the circuitry pseudorandomly selects one of the bits from one of the memory planes, and which bit is then decremented via the decrement logic circuitry 47 and written back into the local zoom memory 40 at the appropriate address and at the rate determined by the variable timer 45. The proper address location now, however, is maintained via the circuitry of FIG. 5.

Figure 5:
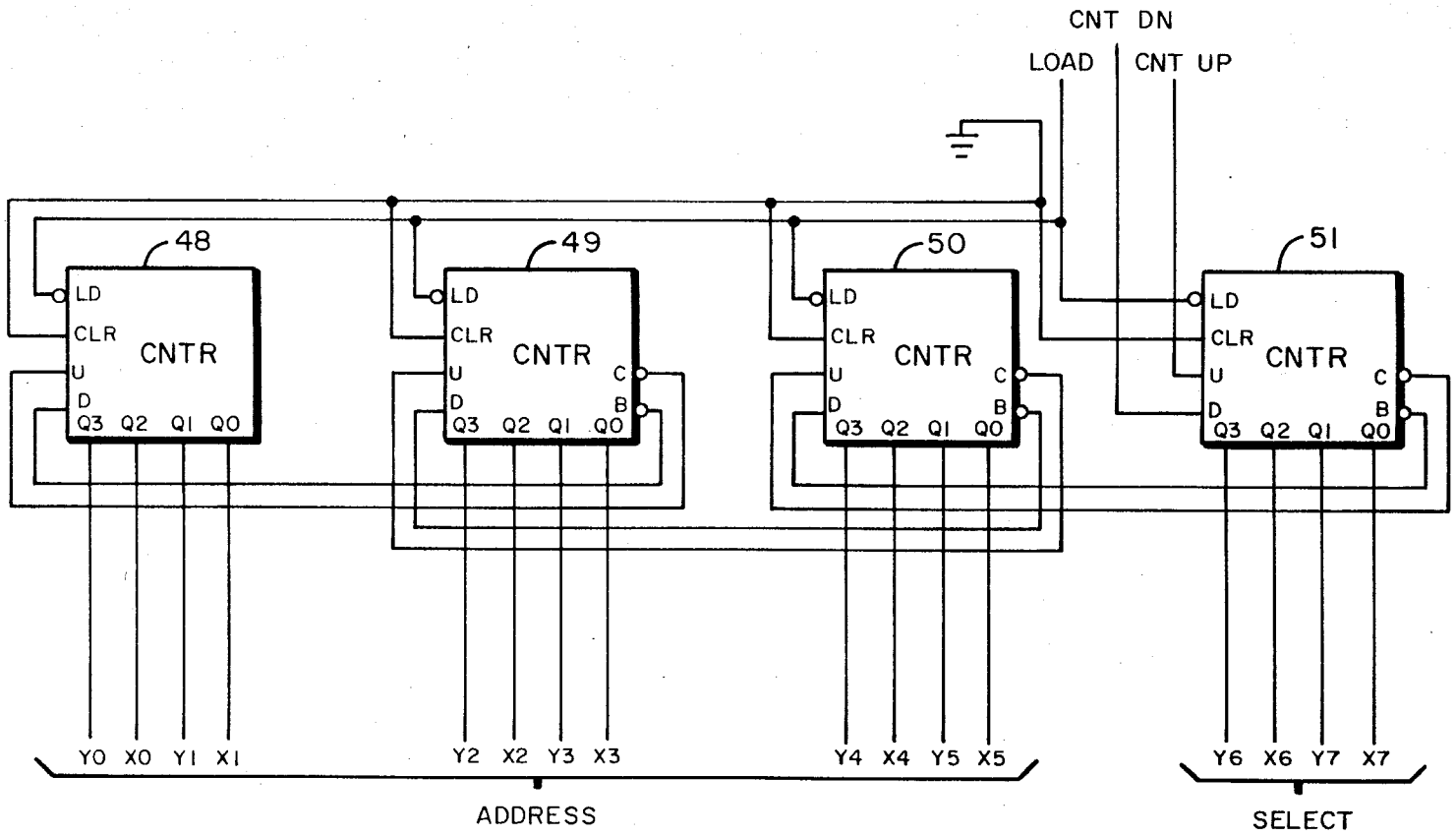
FIG. 5 shows a detailed schematic diagram of a programmable intensity decrement address counter.

Referring to FIG. 5, it is to be noted that the proper address is determined via the outputs of counters 48, 49 and 50; while the pseudorandom selection of one of the bits in the latch 44 is determined via the four bit output of the counter 51. With respect to this selection, the variable timer 45 now causes a decrement request to be made on the priority control circuitry 46 at fixed intervals, as determined by an operator selected frequency. Thus, in lieu of varying the rate of selection, the circuitry, instead, pseudorandomly scrambles the four bits of counter 51 from which the one of the five bit quantities at one of the sixteen pixel locations within the word located by the address developed as the twelve signals from counter 48 through counter 50. It is to be noted that the bit scrambling occurs via the manner in which the counter bits are coupled to the select inputs of the latch 44. There is also scrambling of the bits which are the outputs of counter 48 through counter 50 and which are inputs to the memory address during a decrementation during a memory update cycle. Thusly both memory address and bits within a memory word of sixteen pixels are pseudorandomly selected in order to accomplish synthetic persistence of the desired quality of smooth image decay.

The present invention therefore enables a pseudorandom decrementation of the data stored in an image memory, so that during refresh, the phosphor decay across the face of the display screen appears uniform. And while the present invention has been described with respect to alternative word and bit decrementation schemes, it is to be recognized that yet other equivalent schemes might be suggested to one of skill in the art upon a reading hereof. Therefore, the present invention as set forth in the following claims should be interpreted to include such equivalents.

What is claimed is:

1. An improved display system having apparatus for periodically refreshing images displayed on the screen, wherein the improvement comprises:

refresh control means for reading each of successive addresses, and accompanying data thereto, said data representing intensity of a display image, from an image memory during display refresh operations;

data decrementation means for decrementing the data from said refresh operations, producing by said decrementing decremented data representing a display image of reduced intensity to that said display image which was represented by said data prior to decrementation;

pseudorandom selection means for pseudorandomly selecting certain ones of said successive addresses as pseudorandomly selected addresses; and restoration means for writing said decremented data which was produced from the data accompanying said pseudo-randomly selected addresses back into said image memory at said pseudorandomly selected addresses.

2. Apparatus asset forth in claim 1 wherein said pseudorandom selection means includes a counter for producing a series of numbers, the numbers in said series being dependent upon a predetermined odd number, which number is not evenly divisible into nor evenly divisible by the numbers of successive addresses within said image memory, series of member representing said ones of said successive addresses to be selected addresses;

whereby, by the properties of said fixed odd number, said selected addresses will appear to be psuedorandomly selected addresses relational to said reading of said image memory during said display refresh operatings.

3. Apparatus as set forth in claim 2 wherein said predetermined number is obtained from a programmable store.

* * * * *